US009444227B2

(12) United States Patent
Däumer et al.

(10) Patent No.: US 9,444,227 B2
(45) Date of Patent: Sep. 13, 2016

(54) SPARK GAP ARRANGEMENT AND METHOD FOR SECURING A SPARK GAP ARRANGEMENT

(71) Applicant: EPCOS AG, Munich (DE)

(72) Inventors: Wolfgang Däumer, Zeuthen (DE); Thomas Westebbe, Berlin (DE)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 14/646,248

(22) PCT Filed: Dec. 12, 2013

(86) PCT No.: PCT/EP2013/076410

§ 371 (c)(1),
(2) Date: May 20, 2015

(87) PCT Pub. No.: WO2014/095579

PCT Pub. Date: Jun. 26, 2014

(65) Prior Publication Data

US 2015/0333488 A1 Nov. 19, 2015

(30) Foreign Application Priority Data

Dec. 18, 2012 (DE) ..... 10 2012 112 543

(51) Int. Cl.
*H01T 13/26* (2006.01)
*H01T 13/08* (2006.01)
*H01T 2/02* (2006.01)

(52) U.S. Cl.
CPC ..... *H01T 13/26* (2013.01); *H01T 2/02* (2013.01); *H01T 13/08* (2013.01)

(58) Field of Classification Search
CPC ..... H01T 13/08; H01T 13/26; H01T 2/02
See application file for complete search history.

(56) References Cited

U.S. PATENT DOCUMENTS

| | | | | |
|---|---|---|---|---|
| 6,522,679 | B1 * | 2/2003 | Strowitzki | H01S 3/038 372/51 |
| 2007/0297479 | A1 * | 12/2007 | Swinney | H01S 3/225 372/58 |
| 2008/0069170 | A1 * | 3/2008 | Shackleton | H01S 3/09713 372/61 |

FOREIGN PATENT DOCUMENTS

| | | | |
|---|---|---|---|
| DE | 102012101558 | A1 | 8/2013 |
| FR | 2479587 | A1 | 10/1981 |
| WO | 2006045947 | A1 | 5/2006 |
| WO | 2007150048 | A2 | 12/2007 |

OTHER PUBLICATIONS

Däumer, W., et al., "Triggered spark gap with internal trigger delay circuit," 4th ITG International Vacuum Electronics Workshop, Oct. 13-14, 2014, 17 pages.

* cited by examiner

*Primary Examiner* — Douglas W Owens
*Assistant Examiner* — Pedro C Fernandez
(74) *Attorney, Agent, or Firm* — Slater Matsil, LLP

(57) ABSTRACT

A spark gap arrangement includes a discharge chamber, an electrode head and a contact connection arranged outside the discharge chamber. The electrode head is electrically conductively connected and mechanically coupled to the contact connection in such a way that, when the contact connection is removed from its position or when the contact connection reaches a preset position, the electrically conductive connection is interrupted, and the electrode head is mechanically decoupled from the contact connection so that the electrode head is movable in the direction of the discharge chamber interior and/or within the discharge chamber.

18 Claims, 1 Drawing Sheet

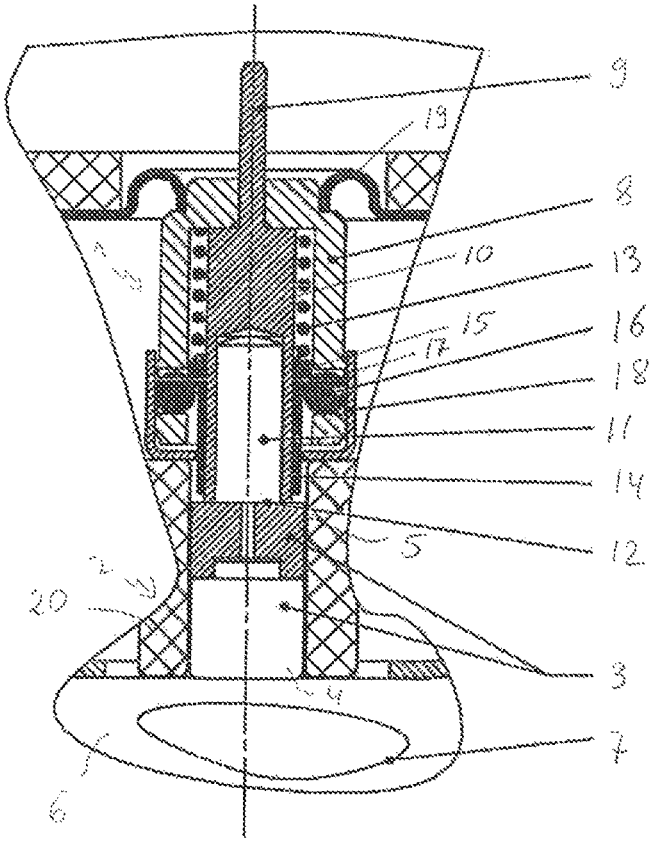
9
19
8
10
13
15
16
18
11
14
5
12
20
3
7
6

SPARK GAP ARRANGEMENT AND METHOD FOR SECURING A SPARK GAP ARRANGEMENT

This patent application is a national phase filing under section 371 of PCT/EP2013/076410, filed Dec. 12, 2013, which claims the priority of German patent application 10 2012 112 543.0, filed Dec. 18, 2012, each of which is incorporated herein by reference in its entirety.

TECHNICAL FIELD

The invention relates to a spark gap arrangement which is protected against manipulations.

BACKGROUND

Spark gap arrangements are in widespread use. One embodiment is a triggerable spark gap, which is also referred to as a trigger spark gap. A trigger spark gap generally has at least two main electrodes and a trigger electrode. For example, the electrodes are arranged in a gas-filled space. By applying a corresponding trigger voltage to the trigger electrode, a spark gap is struck between the trigger electrode and one of the main electrodes. For example, in this case an ionized gap is produced in the gas-filled space, via which gap a current flows between the trigger electrode and one main electrode. By virtue of the striking by means of the trigger electrode, a further conductive channel is then formed between the two main electrodes, which enables a current flow between the main electrodes.

Such triggerable spark gaps can be used as surge arrestors, for example. Another possible use consists in the targeted connection of high voltage, for example.

In conventional triggerable spark gaps, connection between the main electrodes is initiated directly by means of the application of the trigger pulse to the trigger electrode.

A typical delay time for a gas-filled trigger spark gap can be in the region of less than 1 μs. The delay time is in this case dependent on the level of the generator voltage at the main electrodes in relation to its self-breakdown voltage, SBV for short. The lower the generator voltage is, the longer the delay time will be. This is furthermore also dependent on the level of the trigger voltage. The lower the trigger voltage is, the longer the delay time. By matching the abovementioned variables, the delay time can be set to a certain degree.

SUMMARY

In some applications a long delay time is desirable. A typical value is a delay time which is intended to be longer than 15 μs. In this regard it will be noted that gas-filled trigger spark gaps with a current of greater than 500 A and a delay time of less than or equal to 15 μs can be subjected to restrictions in respect of their use and export.

Although the delay time can be influenced, as outlined above, it is not possible, however, to achieve a striking delay for a gas-filled trigger spark gap which statistically reliably exceeds a high limit value, such as 15 μs. Instead, it is the case that the values of the delay time are subject to a high level of scatter and a component with a delay time of less than 15 μs is still present in a charge.

In order to meet these requirements, therefore, a striking delay circuit can be provided in the trigger spark gap which has the effect that the preset time delay between the trigger pulse and breakdown is adhered to. Thus, the condition whereby the delay time is above the typical limit value of 15 μs can be met.

As regards the desired absolute maintenance of the desired minimum delay time, such a spark gap is intended to be protected from manipulations of the delay time. In particular, the intention is to prevent the striking delay circuit from being overridden.

To this end, a spark gap can comprise a discharge chamber, an electrode head and a contact connection which is arranged outside the discharge chamber. The electrode head is electrically conductively connected and mechanically coupled to the contact connection in such a way that, when the contact connection is removed from its position or when the contact connection reaches a preset position, the electrically conductive connection is interrupted and the electrode head is mechanically decoupled from the contact connection so that the electrode head is movable in the direction of the discharge chamber interior and/or within the discharge chamber.

The discharge chamber is a gas-filled, for example, air-filled, space in which the discharge or spark gap formation between electrodes can take place. It can be closed off. The discharge chamber can be delimited by insulator and/or electrode walls.

The electrode head is an electrically conductive part, at which a transition of the current passed through the connection contact into the gaseous medium in the discharge chamber can take place. The electrode head can comprise the trigger electrode in a trigger spark gap, for example. It can terminate with an insulating wall of the discharge chamber or protrude at least partially or entirely into the charging chamber interior.

The actuation of and supply to the electrode head take place via the contact connection. For example, a striking delay circuit is connected to the contact connection. Such a connection is generally not detachable, or only detachable with difficulty. As a result, already an attempt to remove or manipulate the striking delay circuit results in a movement of the contact connection out of its original position. This has the effect that the electrode head is both electrically decoupled, which prevents the application of a voltage and in particular a trigger pulse, and is mechanically decoupled, with the result that the electrode head is movable out of its position and, owing to the force of gravity or owing to its spring force, can fall into the discharge chamber interior. An electrode head which has already been positioned in the interior in advance is no longer held in its position and is movable in the discharge chamber. In both cases, the electrode head can be removed from its position with respect to the main electrodes owing to vibrations, for example, which impairs the operation of the spark gap arrangement.

A detached electrode head located in the charging chamber interior can no longer be coupled to the contact connection, with the result that the functionality of the spark gap arrangement is permanently disrupted. Therefore, not only does the striking delay become below the preset value, but the operation of the entire spark gap arrangement is suppressed.

In the normal operating state of the spark gap arrangement, which is a trigger spark gap, the operation of the spark gap arrangement is ensured by virtue of the fact that the electrode head of the trigger electrode maintains its normal position relative to the main electrode and the electrical connection to the contact connection and therefore to the striking delay circuit exists.

One configuration of the spark gap arrangement comprises a coupling mechanism comprising a first coupling part, which comprises the contact connection, and a second coupling part, which comprises the electrode head. The first coupling part is movable relative to the second coupling part. When the contact connection is removed from its position or when the contact connection reaches a preset position, the electrode head is decoupled mechanically permanently from the contact connection.

The permanent mechanical decoupling does not necessarily have to already take place with only a very small movement of the contact connection, as may occur during rough operation, for example, but can also take place as soon as the contact connection has reached a preset position. The preset position is the minimum change in position of the contact connection in which the first coupling part and the second coupling part have been removed from one another in such a way that the mechanical decoupling is permanent, or irreversible.

It will be noted that the disconnection of the electrical connection and the permanent disconnection of the mechanical connection do not necessarily need to coincide. Even in the case of a small deflection of the contact connection, interruption of the electrical connection can take place, but the mechanical decoupling does not yet take place permanently. The permanent decoupling can take place after the electrical decoupling as soon as the contact connection has reached a preset position.

The decoupled electrode head, which is movable in the direction of the discharge chamber space or within the discharge chamber, can leave its original position after the decoupling and move within the discharge chamber, driven by the force of gravity and changes in movement of the spark gap arrangement. This is one possible way of achieving the permanent decoupling. Movements during operation or the force of gravity can be sufficient for the decoupled electrode head to slide out of its position hold.

In one embodiment, the electrode head is coupled to the contact connection via a magnetic connection. The first or the second coupling part can comprise this magnet. Advantageously, the magnet is provided in the first coupling part and holds the electrode head in its position by means of the magnetic material properties. As soon as the first coupling part is moved relative to the second coupling part when the contact connection is removed from its position or reaches a preset position, the magnet is also moved away from the electrode head. In this case, the magnetic attraction force to the electrode head is no longer sufficient for holding the electrode head fixedly in its position.

If the spark gap arrangement is subjected to high temperatures, the magnetization is reduced to such an extent that the electrode head can no longer be held fixedly. Even in the case of high levels of acceleration of the spark gap arrangement, the magnetic connection can be detached.

In one configuration, the spark gap arrangement comprises an ejection mechanism, which is tripped when the contact connection is removed from its position or when the contact connection reaches a preset position. This ejection mechanism is suitable for moving the electrode head in the direction of the discharge chamber interior and/or within the discharge chamber.

This ejection mechanism enables the movement of the electrode head out of its original position even counter to the Earth's gravitational pull or independently of its setting with respect to the Earth's gravitational pull. A movement with the Earth's gravitational pull, i.e., in a vertical setting, is assisted by the ejection mechanism, which enables safe and permanent decoupling of the electrode head by virtue of the electrode head being thrust into the discharge chamber interior. The previously problem-free operation of the spark gap arrangement is thus interrupted and can also not be reproduced owing to manipulations in the area behind the switch. The spark gap arrangement becomes unusable.

By means of this spark gap arrangement, a force effect is exerted on the electrode head owing to mechanical and magnetic properties, by means of which force effect the electrode head is moved out of its original position. As a result, the operation of the spark gap arrangement is overridden if an attempt is made to manipulate the contact connection, for example, by virtue of the delay time electronics being removed from the trigger spark gap.

In one configuration, the ejection mechanism comprises a spring element, which is held in a pretensioned state by a detent. During tripping of the ejection mechanism, the detent releases the spring element and, owing to the spring force which acts on the electrode head, the electrode head is thrust out of its position. A spring element is a component part which yields on loading and returns to its original shape from the pretensioned state after load relief, i.e., has an elastically restoring behavior. Advantageously, tension or compression springs are used which experience a change in length on loading. Examples of these are helical compression springs or leaf springs.

Advantageously, the first or the second coupling part comprises a guide bush, in which the spring element is positioned. Such a guide bush holds the spring element in the pretensioned state in its position and, after unblocking, enables targeted guidance of the restoring spring in the direction of the electrode head. A guide bush can be in the form of a pot or sleeve, for example. Advantageously, the spring element is a helical compression spring whose length is reduced in the pretensioned state. It can be positioned adjacent to the inner walls of the guide bush and also provides space in the center for further components of the coupling mechanism, for example, the magnet.

The detent can be moved from a position in which it blocks the restoring of the spring element into a position in which it enables the restoring of the spring element. In other words, the detent is positioned in such a way that it is in the way of the restoring of the expanding spring. In this case, the first and second coupling parts are coupled in such a way that the movement of the detent is initially blocked and is only enabled when the contact connection is removed from its position or when the contact connection reaches a preset position.

In addition, a movable ejector can be provided, which is arranged between the spring element and the electrode head. The detent engages in this ejector so that a movement of the ejector is blocked and the spring element is held in its pretensioned state. When the strain of the spring element is relieved once the detent is released, the spring element moves back into its original form and thus moves the ejector in the direction of the electrode head so that the electrode head is pushed out of its original position and thrusts the electrode head into the discharge chamber interior.

A detent as described above can comprise a sphere or a pin, i.e., a cylindrical element. The detents are positioned in a cutout in the guide bush. A retaining means blocks the movement of the sphere or the pin into the position in which the restoring of the spring element is enabled so that, when the contact connection is removed from its position or when the contact connection reaches a preset position, the sphere or the pin are moved away from the retaining means into the position in which the restoring of the spring element is enabled. Such a retaining means can be a wall, a pot or a sleeve, which impede the sphere or the pin in the movement with which the spring element is released during normal operation. Only when the contact connection is removed from its position or when the contact connection reaches a preset position do the spheres or pins, together with the guide bush, leave their original position. As soon as they are moved away from the retaining means which press them into position, the spring force pushes them to one side so that the spring element can be detensioned.

The corresponding method for securing a spark gap arrangement, as described above, from manipulation comprises the fact that the contact connection is removed from its position, the electrically conductive connection is interrupted, the electrode head is mechanically decoupled from the contact connection, and the electrode head is moved in the direction of the discharge chamber interior and/or within the discharge chamber.

BRIEF DESCRIPTION OF THE DRAWINGS

The invention will be explained below with reference to the drawing on the basis of an exemplary embodiment.

The single FIGURE shows a cross-sectional detail of an essential part of an exemplary embodiment of a spark gap arrangement.

DETAILED DESCRIPTION OF ILLUSTRATIVE EMBODIMENTS

The spark gap arrangement, in this case a trigger spark gap, comprises a discharge chamber 6, a section of which is illustrated, comprising two main electrodes (not illustrated), which can be arranged at the end in the discharge chamber 6, for example. In addition, a trigger head 3 acting as electrode is provided between the main electrodes, the trigger head being actuated, via a contact connection 9, by a striking delay circuit (not illustrated). The contact connection 9 and the striking delay circuit are advantageously connected to one another in such a way that they are at least difficult to detach from one another. The contact connection 9 can also be an integral part of the striking delay circuit.

The detail of the spark gap arrangement shows the coupling mechanism comprising a first coupling part 1 and a second coupling part 2. The second coupling part 2 comprises the trigger head 3 with an electrode head 4 and a magnetic connecting piece 5, which is connected to the electrode head 4. The materials of the electrode head 4 and the connecting piece 5 can be different, which enables optimization of materials in respect of their respective function. Alternatively, the trigger head 3 can be formed in one piece from metal, which can be held by a magnet or is itself a magnetic metal (not illustrated).

The electrode head 4 is positioned in a cutout in the electrically insulating wall 20 of the discharge chamber 6 so that its lower side terminates flush. This cutout acts as a frame for holding the electrode head and holding it in position. Alternative exemplary embodiments have an electrode head 4 which protrudes into the discharge chamber 6, an electrode head 4 which is positioned within the discharge chamber or an electrode head 4 which is set back with respect to the wall 20 (not illustrated).

The main discharge gap 7 along which the discharge can extend is located beneath this electrode head 4.

The first coupling part 1 comprises a contact connection 9, which becomes a cylindrical connecting piece 10. Alternatively, the connection contact 9 and the connecting piece 10 can also be manufactured in two parts. A cutout is provided within the connecting piece 10, with an in this embodiment cylindrical magnet 11 being located in the cutout. A magnetic connection 12 exists between the magnet 11 and the trigger head 3 so that both the magnet 11 and the connecting piece 10 or only one of these components touch/touches the trigger head 3. By virtue of the connecting piece 10, which comprises conductive material in the same way as the connection contact 9, there is an electrically conductive connection between the electrode head 4 and the connection contact 9. Alternatively, the connecting piece 10 and the magnet 11 can also be manufactured in one piece. Other shapes are conceivable.

The first coupling part 1 furthermore has a pot-shaped guide bush 8, with the connection contact 9 protruding out of the base thereof. The side walls of the guide bush 8 run around the connecting piece 10 spaced apart therefrom. The guide bush 8 and the connecting part 10 or the contact connection 9 are connected to one another. Alternatively, the connecting piece 10, with or without connection contact 9, and the guide bush 8 can be manufactured as one piece, i.e., in one piece.

A spring element 13, in this case a helical compression spring, is provided between the connecting piece 10 and the inner walls of the guide bush 8. A sleeve-shaped ejector 14, which is positioned so as to run around the connecting piece 10 between the spring element 13 and the trigger head 3, is provided beneath the spring element 13. The ejector sleeve 14 has a flange 15 on its rim facing the spring element 13. The spring element 13 is clamped in between the base of the guide bush 8 and the flange 15 so that it is in a pretensioned state.

That region of the guide bush 8 which faces the trigger head 3 is positioned in a pot 18 running around the outer side, with the lower region of the connecting piece 10 to the trigger head 3 running through its base. The side walls of the guide bush 8 reach wholly or partially into the pot 18. Alternatively, a sleeve or wall is also conceivable. The pot 18 is connected to the walls 20 forming the cutout for the electrode head 4 so that both the guide bush 8 and the decoupled electrode head 4 are movable with respect to the pot 18.

In that region of the guide bush 8 which faces the trigger head 3 and which is positioned in the pot 18, cutouts 17 are provided. Detents can be guided through the cutouts 17 beneath the flange 15 towards the ejector sleeve 14. In this exemplary embodiment, spheres 16 are provided as detents. For example, two opposing spheres 16 can be provided which are in the cutouts between the pot inner wall and the ejection sleeve outer wall. More than two spheres are also possible. Even one sphere can be sufficient. The size of the spheres 16 is selected such that, when they bear against the pot inner wall, they protrude beyond the inner wall of the guide bush 8 and, lying beneath the flange 15, prevent the movement thereof in the direction of the electrode head 4. As a result, both the ejector sleeve 14 and the pretensioned spring element 13 are held in position.

The spring element 13 is enclosed in the guide bush 8 and, via the detent action of the sphere, impedes any development of force thereof as long as the spheres 16 are held in their position by the pot 18.

The first coupling part 1 can be held in its position by holding means 19, for example, hooks, springs or snap-action connections, which attach to the guide bush 8, for example, in the spark gap assembly during normal operation. These holding means 19 enable a movement of the guide bush 8 which results in decoupling of the electrode head 4 even in the case of low-level manipulations on the contact connection 9, for example, attempted detachment of the delay circuit fastened thereto (not illustrated).

A coupling mechanism, as described above, for example, enables problem-free functioning of the spark gap arrangement in the normal operation mode thereof by virtue of the fact that the electrode head 4 maintains its position relative to the main electrode and also the electrically conductive connection to the contact connection 9 is maintained. This is achieved by virtue of the fact that the electrode head 4 is coupled to the contact connection 9 via the magnetic connection 12. Via this contact connection 9, the supply of trigger voltage and current can take place from a rear space of the spark gap arrangement acting as switch via the delay time circuit.

If the guide bush 8 as well as the connecting piece 10 are moved away from the electrode head 4, for example, in the case of an attempt at manipulation, the magnetic connection 12 to the electrode head 4 is firstly interrupted since both the guide bush 8 and the contact connection 9 and the connecting element 10 with the magnet lying on the inside are moved away from the electrode head 4. As the guide bush 8 is withdrawn further out of the pot 18, the spheres 16 will avoid the flange 15 on which the spring force is acting towards the outside and release the spring-loaded ejector sleeve 14. The ejector sleeve 14 will thrust the electrode head 4 of the trigger electrode, even counter to the force of gravity, into the main discharge gap 7 or into the discharge chamber interior. This effects permanent mechanical decoupling and suppresses the operation of the spark gap arrangement.

The interruption of the electrical and mechanical contact to the electrode head 4 takes place in the event that the contact connection 9 and therefore the supply to the delay circuit is intended to be manipulated or the delay circuit is intended to be removed. The magnetic attractive force to the electrode head 4 is no longer sufficient for holding the electrode head fixedly. Furthermore, the spring force acts additionally so that the electrode head 4 is moved into the discharge chamber 6. The operation of the spark gap arrangement is thus permanently suppressed.

It will be noted that the features of the described configurations and exemplary embodiments can be combined with one another.

The invention claimed is:

1. A spark gap arrangement comprising:

a discharge chamber;

an electrode head; and a contact connection arranged outside the discharge chamber to prevent manipulation, wherein the electrode head is electrically conductively connected and mechanically coupled to the contact connection in such a way that, when the contact connection is removed from its position or when the contact connection reaches a preset position, the contact connection is interrupted and the electrode head is mechanically decoupled from the contact connection so that the electrode head is permanently ejected in a direction of an interior of the discharge chamber or within the discharge chamber in order to permanently disable the spark gap.

2. The spark gap arrangement according to claim 1, wherein the electrode head is coupled to the contact connection via a magnetic connection.

3. The spark gap arrangement according to claim 1, comprising a coupling mechanism comprising a first coupling part, which comprises the contact connection, and a second coupling part, which comprises the electrode head, wherein the first coupling part is movable relative to the second coupling part, and when the contact connection is removed from its position or when the contact connection reaches a preset position, the electrode head is mechanically decoupled permanently from the contact connection.

4. The spark gap arrangement according to claim 3, wherein the electrode head is coupled to the contact connection via a magnetic connection.

5. The spark gap arrangement according to claim 4, wherein the first coupling part comprises a magnet.

6. The spark gap arrangement according to claim 5, wherein the second coupling part comprises a magnet.

7. The spark gap arrangement according to claim 4, wherein the second coupling part comprises a magnet.

8. The spark gap arrangement according to claim 1, comprising an ejection mechanism, which is triggered when the contact connection is removed from its position or when the contact connection reaches a preset position, and which is configured to move the electrode head in the direction of the interior of the discharge chamber or within the discharge chamber.

9. The spark gap arrangement according to claim 8, wherein the ejection mechanism comprises a spring element, which is held in a pretensioned state by a detent.

10. The spark gap arrangement according to claim 9, further comprising a coupling mechanism comprising a first coupling part, which comprises the contact connection, and a second coupling part, which comprises the electrode head;

wherein the first coupling part is movable relative to the second coupling part, and when the contact connection is removed from its position or when the contact connection reaches a preset position, the electrode head is mechanically decoupled permanently from the contact connection; and wherein the coupling mechanism comprises a guide bush, in which the spring element is positioned.

11. The spark gap arrangement according to claim 10, wherein the spring element is a helical compression spring.

12. The spark gap arrangement according to claim 10, wherein the first coupling part comprises the guide bush.

13. The spark gap arrangement according to claim 10, wherein the second coupling part comprises the guide bush.

14. The spark gap arrangement according to claim 10, wherein the detent comprises a sphere or a pin, which are positioned in a cutout in the guide bush.

15. The spark gap arrangement according to claim 14, comprising a retainer, which blocks movement of the sphere or the pin into the position in which restoring of the spring element is enabled so that, when the contact connection is removed from its position or when the contact connection reaches a preset position, the sphere and the pin are moved away from the retainer into the position in which the restoring of the spring element is enabled.

16. The spark gap arrangement according to claim 9, further comprising a coupling mechanism comprising a first coupling part, which comprises the contact connection, and a second coupling part, which comprises the electrode head;

wherein the first coupling part is movable relative to the second coupling part, and when the contact connection is removed from its position or when the contact connection reaches a preset position, the electrode head is mechanically decoupled permanently from the contact connection;

wherein the detent is movable out of a position in which it blocks restoring of the spring element into a position in which it enables the restoring of the spring element; and wherein the coupling mechanism is coupled in such a way that movement of the detent is blocked, and when the contact connection is removed from its position or when the contact connection reaches a preset position, unblocking is enabled.

17. The spark gap arrangement according to claim 9, comprising a movable ejector, arranged between the spring element and the electrode head, wherein the detent engages in the ejector so that movement of said ejector is blocked.

18. A method for disabling a spark gap arrangement comprising an electrode head, a discharge chamber and a contact connection arranged outside the discharge chamber to prevent manipulation, wherein the electrode head is electrically conductively connected and mechanically coupled to the contact connection, and wherein the method comprises, when the contact connection is removed from its position, interrupting the contact connection, mechanically decoupling the electrode head from the contact connection, and permanently ejecting the electrode head in a direction of an interior of the discharge chamber or within the discharge chamber in order to permanently disable the spark gap.

* * * * *